US005245815A

United States Patent [19]

Savage

[11] Patent Number: 5,245,815

[45] Date of Patent: Sep. 21, 1993

[54] PRE-WRAPPED GIFT PACKAGE

[76] Inventor: Tommy R. Savage, 2600 Associated Rd., A59, Fullerton, Calif. 92635

[21] Appl. No.: 933,493

[22] Filed: Aug. 21, 1992

[51] Int. Cl.[5] ..... B65B 43/08; B65B 43/10; B65B 11/58; B65B 5/00

[52] U.S. Cl. ..... 53/449; 53/456; 53/458; 53/491; 229/87.19; 229/923

[58] Field of Search ..... 53/449, 456, 458, 491; 493/110, 111, 116; 229/87.19, 923

[56] References Cited

U.S. PATENT DOCUMENTS

| | | | |
|---|---|---|---|
| 1,796,630 | 3/1931 | Stokes | 493/110 |
| 2,015,202 | 9/1935 | Stokes | 493/110 X |
| 2,294,690 | 9/1942 | Perry | 229/6 |
| 2,479,456 | 8/1949 | Arthur | 229/87.19 X |
| 3,049,059 | 8/1962 | Burt | 493/110 |
| 3,343,750 | 9/1967 | Desmond et al. | 229/923 X |
| 3,366,304 | 1/1968 | Peckar et al. | 229/923 X |
| 3,391,856 | 7/1968 | Siegler et al. | 229/87 |
| 3,394,867 | 7/1968 | Gregg | 229/87.19 X |
| 3,443,739 | 5/1969 | Adams, Jr. | 229/923 X |
| 3,451,611 | 6/1969 | Adams, Jr. | 229/37 |
| 3,459,358 | 8/1969 | Adams, Jr. | 229/37 |
| 3,460,738 | 8/1969 | Adams, Jr. et al. | 229/37 |
| 3,590,699 | 7/1971 | Foley, Jr. et al. | 493/110 |
| 3,790,064 | 2/1974 | Kramer | 229/923 X |
| 3,790,069 | 2/1974 | Straccamore | 229/87 R |
| 3,829,005 | 8/1974 | Hackenberg et al. | 229/39 R |
| 3,833,164 | 9/1974 | Dagostine | 229/87.19 X |
| 3,851,815 | 12/1974 | Desmond et al. | 229/87 R |
| 4,005,814 | 2/1977 | Foster | 229/39 R |
| 4,967,952 | 11/1990 | Roessiger | 229/87.19 |

*Primary Examiner*—Horace M. Culver
*Attorney, Agent, or Firm*—Norman E. Brunell

[57] ABSTRACT

The present invention provides a method of forming a pre-wrapped gift package which appears to have been hand wrapped. The method includes forming a sheet of box construction material with decorative paper affixed thereto into a box tube by joining ends thereof. The box construction material is properly creased and provided with flaps so that a consumer may fold the flattened box tube into a box so that the end flaps form ends of the box and the decorative paper forms a pair of paper flaps which may be overlapped and taped. A flattened pull bow is provided to form a gift wrapping kit with the flattened box tube which may be distributed and displayed in a flat package.

4 Claims, 3 Drawing Sheets

PRE-WRAPPED GIFT PACKAGE

BACKGROUND OF THE INVENTION

1. Field of the Invention

The present invention relates generally to the field of gift wrapped packages and in particular to a pre-wrapped gift box which, when assembled, has the appearance of a hand wrapped gift package.

3. Description of the Prior Art

The gift wrapping of packages is a reoccurring event which is often a time consuming and frustrating experience. It is difficult, without considerable experience, to properly estimate and accurately cut the correct amount and shape of wrapping paper needed. It is also difficult to tightly and neatly attach the paper to the box. To avoid these problems of hand wrapping packages, a gift wrapping service may be employed, however, this is a relatively expensive alternative.

Pre-wrapped gift packaging is presently known, but its pre-wrapped nature is obvious. That is, the gift receiver may easily tell that the gift was not individually, gift wrapped. For example, packages are commercially available consisting of a pre-wrapped open box bottom and a pre-wrapped box cover. Also, packages with printed external surfaces are presently sold, in theory, eliminating the need for separate wrapping. Similarly, boxes with decorative wrapping paper loosely attached are known.

But the giving of gifts in packages which are clearly and noticeably not hand wrapped may convey a lack of caring or consideration. This is opposite to the sentiment normally sought to be conveyed by the giving of a gift. What is needed is pre-wrapped gift package which, when assembled, provides the pleasing appearance of a hand wrapped gift wrapped box and which maintains this appearance after being opened.

SUMMARY OF THE INVENTION

The preceding and other shortcomings of the prior art are addressed and overcome by the present invention which provides, in a first aspect, a method of making a pre-wrapped box by forming a sheet of thin, generally rectangular box construction material into a tube shape having two opposing joint sides and two opposing flap sides, each flap side having a flap crease and a pair of major end flaps alternating with a pair of minor end flaps extending from that flap crease, the major end flaps extending substantially further from the flap crease than the minor end flaps, the sheet including folding creases extending across the flap creases and between each of the alternating pairs of end flaps, the end flaps being sized so that each set of the pairs of major and minor end flaps extending from each said flap crease are closable to form the end portions of a box when the folding creases are in a folded condition and the opposing joint sides are joined to form said sheet into a box, affixing a sheet of decorative paper to one surface of the sheet of construction material at each of the minor flaps, the paper extending across at least a portion of the surface of each major end flap, and folding at two of the folding creases and joining the joint sides to form a flattened box tube which may then be further folded to form a wrapped box.

In another aspect the invention provides a method of enclosing an article in a wrapped box by forming a sheet of thin, generally rectangular box construction material into a shape having two opposing joint sides and two opposing flap sides, each flap side having a flap crease and a pair of major end flaps alternating with a pair of minor end flaps extending from that flap crease, the major end flaps extending substantially further from the flap crease than the minor end flaps, the sheet including folding creases extending across the flap creases and between each of the alternating pairs of end flaps, the end flaps being sized so that each set of the pairs of major and minor end flaps extending from each said flap crease are closable to form the end portions of a box when the folding creases are in a folded condition and the opposing joint sides are joined to form said sheet into a box, affixing a sheet of decorative paper to one surface of the sheet of construction material at each of the minor flaps, the paper extending across a portion of the surface of each major end flap, folding at least two of the folding creases, joining the joint sides to form a flattened box tube, folding the remaining creases to form an open box tube shape, folding one pair of the major end flaps to close one end of the box tube, folding the corresponding minor end flaps and a portion of the wrapping paper affixed to the minor end flaps over the major end flaps, thereby causing a portion of the wrapping paper formerly covering a portion of each major end flap to assume a folded shape, creasing the folds of the folded portions of the wrapping paper to form a pair of opposing wrapping paper flaps, folding the opposing wrapping paper flaps over the end flaps to overlap one another, affixing the overlapping wrapping paper flaps together to close one end of a wrapped box, inserting an article in the box, and closing the other end of the box by performing a similar series of operations with the other pair of end flaps to form a wrapped box enclosing the article.

In still another aspect, the present invention provides a pre-wrapped gift box kit including a pre-formed sheet of thin, generally rectangular box construction material having two opposing joint sides and two opposing flap sides, each flap side having a flap crease and a pair of major end flaps alternating with a pair of minor end flaps extending from that flap crease, the major end flaps extending substantially further from the flap crease than the minor end flaps, the sheet including folding creases extending across the flap creases and between each of the alternating pairs of end flaps, the end flaps being sized so that each set of the pairs of major and minor end flaps extending from each said flap crease are closable to form the end portions of a box when the folding creases are in a folded condition and the opposing joint sides are joined to form said sheet into a box, and a sheet of decorative paper affixed to one surface of the sheet of construction material at each of the minor flaps, the paper extending across a distance greater than or equal to one half the width of the minor flap and less than or equal to one half the width of a major flap, means for joining the joint sides, and means for securing together folded paper flaps formed by the folding of the minor flaps over the major flaps when the combined sheets are formed into a box. The affixed sheets of construction material and paper may be formed in the shape of a flattened box tube and packaged with a flattened pull bow to form a flat, easy to handle gift decorating kit.

These and other features and advantages of this invention will become further apparent from the detailed description that follows, which is accompanied by several drawing figures. In the figures and description, numerals indicate the various features of the invention, like numerals referring to like features throughout both the drawings and the description.

Detailed Description of the Preferred Embodiment

The present invention provides an easily formed pre-wrapped package having the pleasing appearance of a hand wrapped box.

Figure 1:
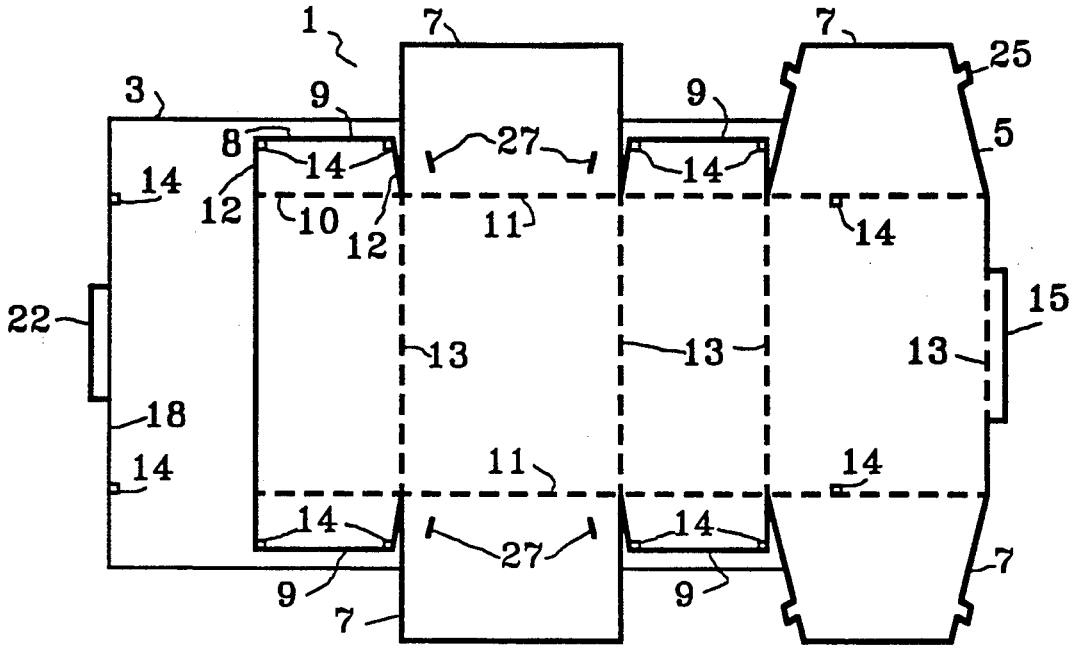
FIG. 1 is a top plan view of a partially assembled box tube including a flat sheet of box construction material, cut and creased for folding, overlying a flat sheet of gift wrapping attached thereto in accordance with the present invention.
Figure 2:
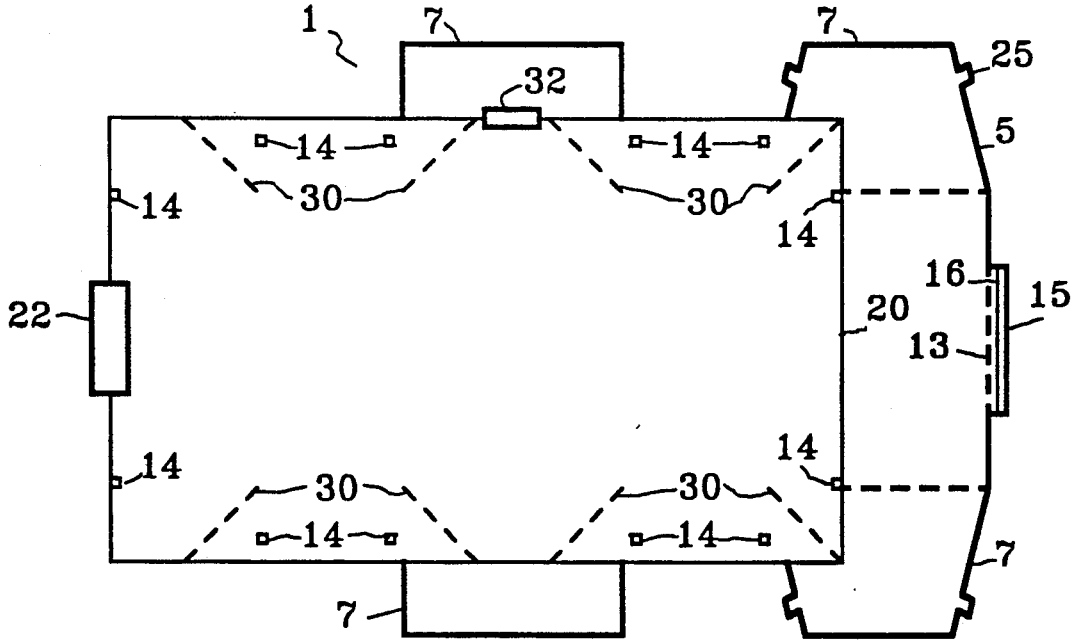
FIG. 2 is a top plan view of the attached sheets of box construction material and wrapping paper shown in FIG. 1 which have been rotated to show the wrapping paper on top.

Referring to FIGS. 1 and 2, a presently preferred embodiment of the invention includes a generally rectangular sheet 1 of box construction material overlying a piece of wrapping paper 3 affixed thereto. Sheet 1 may be a die cut and creased piece of cardboard or other similarly formed thin sheet of material suitable for gift box construction. Sheet 1 is formed to have body 5, four major end flaps 7 and four minor end flaps 9. Two major end flaps 7 and two minor end flaps 9 are alternately located along each long or flap side of body 5, like sized end flaps opposing each other.

Sheet 1 is creased in several places to facilitate its being folded into a closed box. Horizontal or flap creases 11 define the juncture of body 5 with end flaps 7 and 9 and are the lines along which end flaps 7 and 9 are to be folded. Inner edge 10 of minor end flap 9, for example, lies along horizontal crease 11. Vertical or folding creases 13 form the lines along which body 5 is to be folded and define the width of the sides of the box to be formed.

Each minor end flap 9 is slightly narrower at its outer edge 8, than its crease edge 10, to leave room for the creased wrapper paper in order to produce a cleanly wrapped package that is clearly individually, hand wrapped. For convenience of the description herein, the width of each flap will be considered to be its width along horizontal crease 11, e.g. crease edge 10, while the extension of each flap will be the distance from the edge of the flap along the horizontal crease to the flap outer edge, such as outer edge 8. As noted below, if the assembled gift box is to be square in shape, the widths of all major and minor end flaps 7 and 9 will be approximately the same. The extensions of such flaps will be different as described herein below.

End tab 15 is utilized to form a lap joint with the opposite end of body 5 to hold folded body 5 together when the vertical crease 13 adjacent end tab 15 is folded. The joint may be formed by adhesive material positioned, for example, along tacking strip 16 at the outer edge of end tab 15.

Wrapping paper 3 is affixed to folded body 5 at many points, such as tacking points 14, each of which may be formed by crimping wrapping paper 3 to folded body 5, or by providing a drop of adhesive between wrapping paper 3 and folded body 5, or by any other convenient mechanism which results in the handling and appearance of a hand wrapped box when that box is unwrapped. Rubber cement or other suitable bonding material may be used. In particular, using tacking points between the paper and the box which readily come apart during unwrapping provides a more hand wrapped appearance than a technique, such as surface taping, which would attach the surface of wrapping paper 3 not in contact with folded body 5 to folded body 5. Surface taping between minor end flaps 9 and the edge of wrapping paper 3 adjacent thereto, for example, interferes with unwrapping and imparts the appearance and feel of a non-hand-wrapped package.

Figure 4:
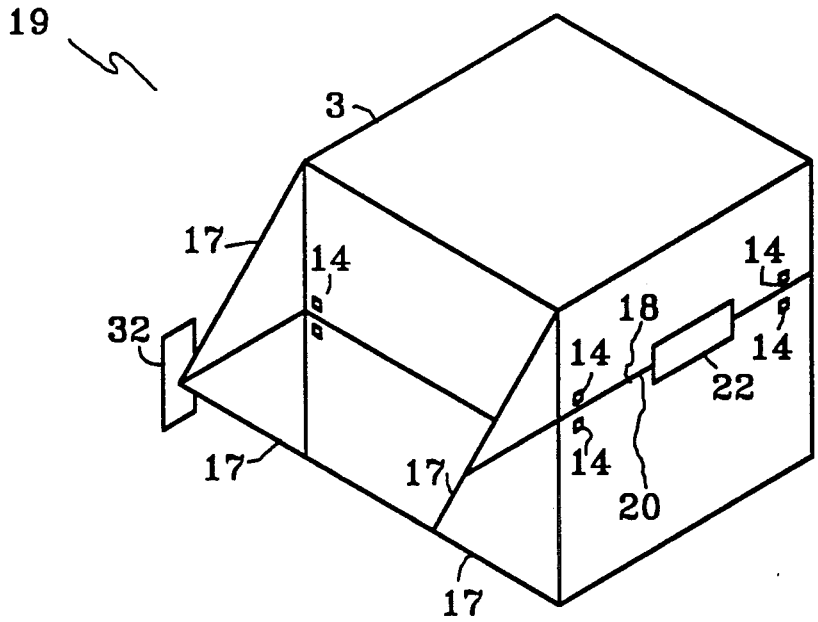
FIG. 4 is the pre-wrapped package shown in FIG. 3 after the end flaps have been folded and folded end portions of the wrapping paper have been creased.

Tacking points 14 are positioned as indicated along the inner edges 12 of minor flaps 9 at the intersection thereof with the outer edge 8 of each such flap. Wrapping paper 3 must be adhered along its inner edges 12 to minor end flaps 9 to insure paper flaps 17, as shown in FIG. 4, are properly formed when minor end flaps 9 are folded, as described below. Additional tacking points 14 may be provided wherever convenient or desired for any particular application, except that each major end flap 7 must not be affixed to the portion of wrapping paper 3 adjacent thereto. In addition, it may be convenient to provide tacking points 14 along wrapping paper seam edges 18 and 20, as shown for example in FIG. 2, to form a seam therebetween.

In addition to tacking points 14 along wrapping paper seam edges 18 and 20, or as an alternate thereto, a small piece of tape, such as tape segment 22, may be used to form the seam. Tape segment 22 may conveniently be used to form the seam between edges 18 and 20 because, during unwrapping, a piece of tape along the paper seam is a normal result of hand wrapping. Tape segment 22 is shown in FIGS. 1, and 2 as attached to first to seam edge 18, for convenience. As shown most clearly in FIGS. 2 and 3, wrapping paper 3 may be affixed to folded body 5 so that the seam formed by joining wrapping paper seam edges 18 and 20 is conveniently positioned along the side of box 19 including major end flaps 7. In this way, when assembled, the seam interferes only minimally with the construction of the box. The seam may also be positioned along the side of the box including a minor flap, but additional tacking points 14 may then be required and the seam may interfere with wrapping paper flaps 17, as shown in FIG. 4.

Figure 3:
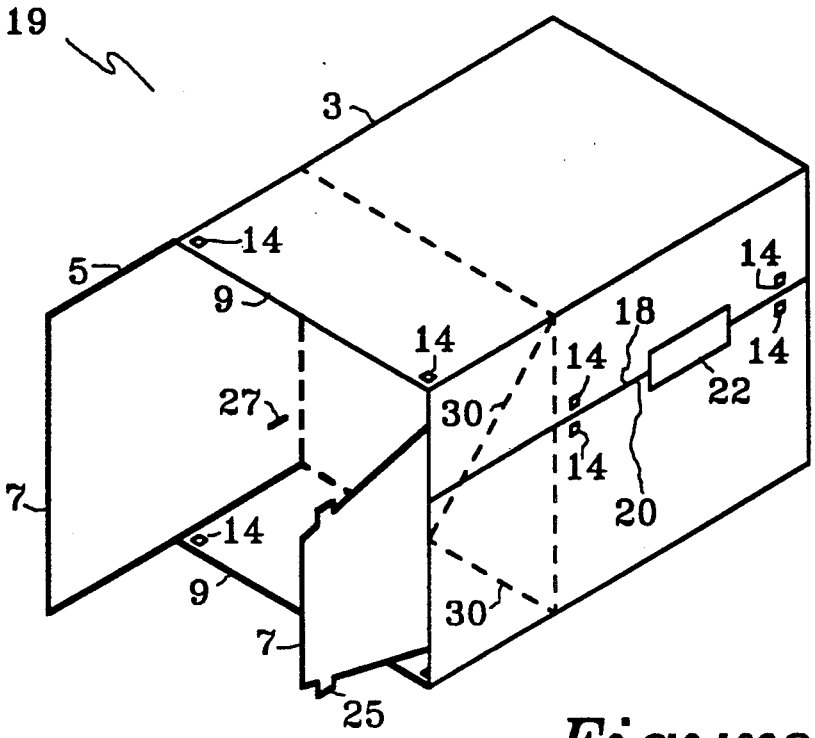
FIG. 3 is an isometric view of a pre-wrapped package formed from a box tube with end flaps on one end in the open position.

The relative sizes of major and minor end flaps 7 and 9, and the relationship of the size of wrapping paper 3 with respect thereto, depends on the desired shape of the final box. The box formed from the configurations shown in FIGS. 1, 2, 5 and 6 will be generally rectangular in cross-sectional shape. That is, the shape of the flap end of the box when assembled will be rectangular. The box shown being formed in FIGS. 3 and 4 is generally square in cross-sectional shape.

With regard first to a rectangular box, as shown for example in FIGS. 1, 2, 5 and 6, the extension of each major flap must be no greater than the width of each minor flap 9 so that the major flaps may be folded over each other, each substantially filling the open area formed at each end of box tube 35 during assembly. Although the extension of the major flaps may be shorter than the width of minor flaps, it is desirable for them to be substantially equal to the width of the minor flaps so that each such major flap fills the open end of the box tube 35 when assembled to provide maximum rigidity unless an interlocking or mating flap configuration is used as described below in greater detail. If the extension of the major flap were greater than the width of minor flap, the major flap would be too long to fold into the box tube end opening.

On the other hand, the extension of each minor flap should be no greater than one half the width of each major flap so that when the minor flaps are folded over the folded major flaps, the end of each minor flap will just meet the end of other minor flap to form a butt joint. If the extension of the minor flaps exceeds one half the width of the major flaps, the minor flaps will overlap each other when the box is assembled. This overlapped condition may be noticeable through the paper covering and is therefore usually undesirable unless required for a particular box application. Although the minor flaps may be completely eliminated, the assembled box will be stronger and will more closely resemble a hand wrapped box when unwrapped if the extension of the minor flaps is only slightly less than one half the width of the major flaps.

The length of wrapping paper 3 is simply equal to or slightly longer than the sum of the widths of the pairs of minor and major flaps. If the length of wrapping paper 3 is longer than this sum, the seam between wrapping paper seam edges 18 and 20 becomes an overlapping seam With one such edge overlapping the other. An overlapping seam is consistent with hand wrapping techniques. The required width of the paper, for a rectangular box, is related to the size of the box as follows. Wrapping paper 3 must be wide enough to extend past each horizontal crease 11, along each major end flap 7, a distance equal to at least one half of the width of the minor flap. It is preferable that the paper does not extend past each horizontal crease 11 more than a distance equal to half the width of the major flaps so that wrapping paper flaps 17, described below, may be made neatly without unnecessary overlapping of folded paper.

With regard now to a square box, the width of the major and minor flaps are equal because of the square shape of the box. The extension of each major flap must therefore be no greater than its width while the extension of each minor flap must be no greater than one half its width. Wrapping paper 3 must be wide enough to extend past each horizontal crease 11, along each major end flap 7, a distance equal to one half of the width of the minor flap.

Referring additionally now to FIGS. 3 through 6, sheet 1 is folded along creases 13 forming a box tube 35 having two pair of opposing surfaces. End tab 15 along one joint side of body 5 is adhered to the opposite end of body 5 to fix sheet 1 in the box tube shape. Sheet 1 may be alternatively fixed in its tubular shape by omitting end tab 15 and applying tape along the end portions of the joint sides of body 5, while they are being held closely together, to form a butt joint.

Figure 5:
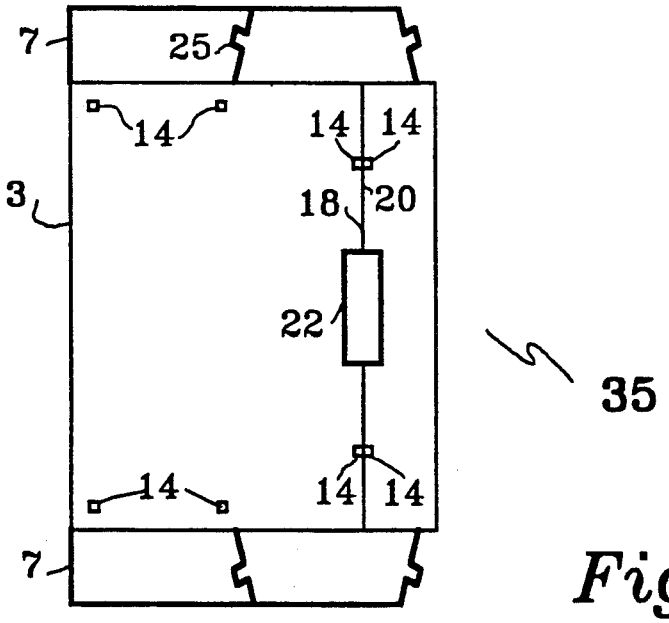
FIG. 5 is a top plan view of the box tube shown in FIGS. 1 and 2 after joining of the joint sides.
Figure 6:
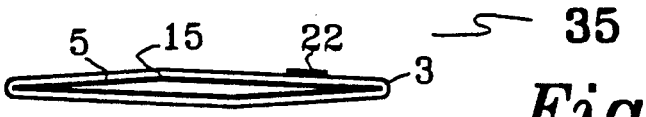
FIG. 6 is an end view of the flattened box tube of FIG. 5.

In either event, after end tab 15 is secured to the opposite edge of folded body 5, or a butt joint is formed in folded body 5, folded body 5 may conveniently be refolded flat along a pair of vertical creases 13 which preferably do not include the joint sides of folded body 5 as shown for example in FIGS. 5 and 6. In this folded flat condition, slightly exaggerated in the end view shown in FIG. 6 for ease of illustration, the pre-wrapped gift box assembly of the present invention may conveniently be inserted into a transparent plastic bag and header assembly and shipped, displayed and sold in a conventional hanging retail sales configuration.

To form the assembly shown in FIGS. 5 and 6 into a wrapped gift box, the remaining vertical creases 13 are folded to form an open box tube as shown in FIG. 3. Major end flaps 7 are then folded, one at a time, into the opening of box tube 35 to form one end of box 19. After major end flaps 7 have been folded into the tube formed by folded body 5, minor end flaps 9 are folded inward to rest on the surface formed by folded major end flaps 7. Wrapping paper flaps 17, as shown in FIG. 4, are formed by the folding of minor end flaps 9. Wrapping paper flaps 17 are creased, folded together and taped, completing the formation of the pre-wrapped package. In an alternate embodiment, wrapping paper 3 may be precreased along precrease lines 30 as shown in FIG. 2.

Tape segment 32 may conveniently be preattached to one such wrapping paper flap 17 as shown in FIG. 6 between pre-crease lines 30 so that completion of each side of the gift box is accomplished by taping tape segment 32 on one wrapping paper flap 17 directly to the top or display surface of the mating wrapping paper flap 17. After one side of box 19 has been formed from box tube 35 by folding and taping, the gift or other object may be inserted in box 19 which is then closed by folding and taping the open end of the box tube in the same manner. When completed, box 19 has the appearance of a gift wrapped package, indistinguishable from boxes separately wrapped with gift paper. When box 19 is opened, the separate or fully hand wrapped, paper gift wrapped appearance of box 19 is maintained.

Although one major flap may simply be folding in on the next major flap, there is a substantial advantage in rigidity and strength of the resulting box 19 to use interlocking major end flaps as shown in the figures. Referring now again to FIG. 1, each pair of major end flaps 7 forming one end of box 19 may be made to interlock with each other. In particular, one such major flap may be fitted with extension tabs 25 while the other major flap includes mating tab slots 27. When box 19 is being assembled from flattened tube 35, as shown in FIG. 5 and 6, the major end flap 7 including mating tab slots 27 is folded first. Then the other major end flap, which includes extension tabs 25, is folded thereover. Extension tabs 25 are then inserted in mating tab slots 27 interlocking the major flaps together.

Tabs 25 and slots 27 are the presently preferred means of interlocking the major end flaps in this embodiment of the invention, but other male/female interlocking configurations may be utilized.

A chart of approximate relative dimensions for an exemplar of sheet 1, which may be utilized to form boxes incorporating principles of the present invention, is shown below.

| Box Size | Body | Minor Flaps | Major Flaps | End Tab |
|---|---|---|---|---|
| 6 × 4 × 4 | 6 × 16 | 2 × 4 | 4 × 4 | 6 × 0.75 |
| 7 × 7 × 7 | 7 × 24 | 3.5 × 7 | 7 × 7 | 7 × 0.75 |
| 8 × 8 × 4 | 8 × 24 | 2 × 4 | 4 × 8 | 8 × 0.75 |
| 9 × 4 × 4 | 9 × 16 | 2 × 4 | 4 × 4 | 9 × 0.75 |
| 9 × 9 × 5.5 | 9 × 29 | 2.75 × 5.5 | 5.5 × 9 | 9 × 0.75 |
| 12 × 6 × 6 | 12 × 24 | 3 × 6 | 6 × 6 | 12 × 0.75 |

Figure 7:
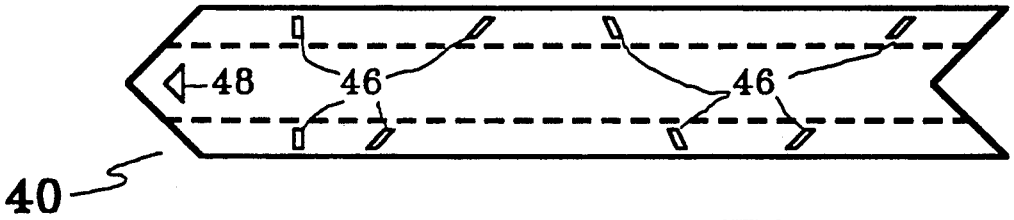
FIG. 7 is a top plan view of a conventional pull bow to be packaged with the flattened box tube of FIGS. 5 and 6 according to the present invention.
Figure 8:
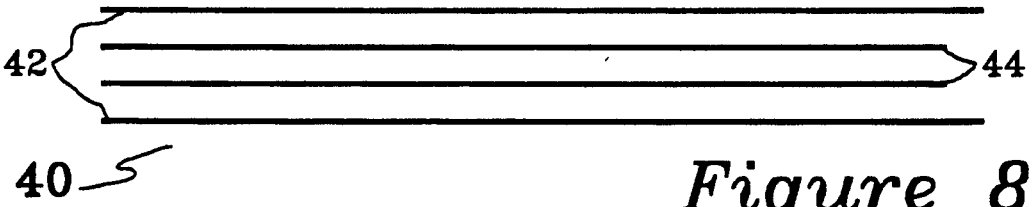
FIG. 8 is an exploded side view of the pull bow of FIG. 7.

The flattened box tube 35 shown in FIGS. 5 and 6 may conveniently by packaged, shipped and displayed in the flattened condition as shown. It is advantageous to provide a ribbon and bow arrangement compatible therewith for use in completing the assembly of box 19 in the same flattened package. Referring now to FIGS. 7 and 8, a ribbon and bow arrangement is the pull bow, such as pull bow 40. Various types of pull bows are known, such as the series of pull bows available from 3M Packaging Systems Division, St. Paul, MN. A pull bow may be shipped in the flattened condition shown for example in FIG. 7 and conveniently extended into a puffy bow and ribbon arrangement at the time as assembly of box 19.

Figure 9:
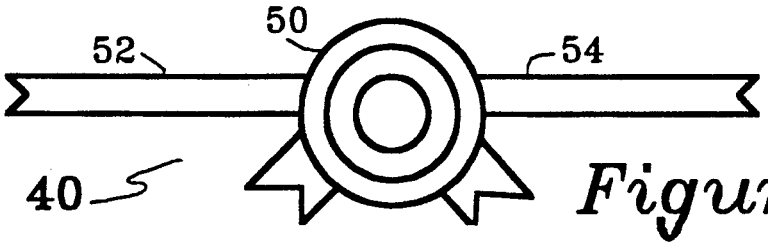
FIG. 9 is a top plan view of the pull bow of FIGS. 7 and 8 after being pulled to form a bow and ribbon arrangement.

The exemplar pull bow shown in FIG. 7 and 8 includes outer ribbon pair 42 surrounding inner ribbon pair 44. Outer ribbon pair 42 is in the form of a hollow tube surrounding inner ribbon pair 44 and held together by a series of tacking points 46 spaced apart from inner ribbon pair 44. In addition, end tacking point 42 is provided which affixes one end of outer ribbon pair 42 to the end of inner ribbon pair 44. The pattern of tacking points 46 through outer ribbon pair 42 and the exact shapes of the ribbon pairs, determines the appearance of the bow, such as decorative bow 50 shown in FIG. 9, formed when inner ribbon pair 44 pulled out of the sheath formed by outer ribbon pair 42. Inner ribbon pair 44 when pulled out of the sheath form package ribbons 52 and 54 which are then conveniently used to secure decorative bow 50 to box 19 to complete the assembly. The required length for package ribbons 52 and 54 depends on both the size and dimensions of box 19 when assembled as well as the way in which the ribbon is positioned around the box. The dimensions for the components of pull bow 40 for various box sizes and ribbon arrangements are well known and may easily be determined.

Pull bow 40 may therefore be combined in a convenient package with box tube 35, as well as segments of tape to form tape segments 22 and 32, to form a gift package wrapping kit which may therefore be packaged in a flat condition for shipping, distribution, storage, and display for retail sale.

Having now described the invention in accordance with the requirements of the patent statutes, those skilled in this art will have no difficulties making changes and modifications in the embodiment of the individual elements of the invention in order to meet their specific requirements or conditions. Such changes and modifications may be made without departing from the scope and spirit of the invention as set forth in the following claims.

What is claimed is:

1. A method of enclosing an article in a wrapped box, comprising the steps of:

forming a sheet of thin, generally rectangular box construction material into a shape having two opposing joint sides and two opposing flap sides, each flap side having a flap crease and a pair of major end flaps alternating with a pair of minor end flaps extending from that flap crease, the major end flaps extending substantially further from the flap crease than the minor end flaps, the sheet including folding creases extending across the flap creases and between each of the alternating pairs of end flaps, the end flaps being sized so that each set of the pairs of major and minor end flaps extending from each said flap crease are closable to form the end portions of a box when the folding creases are in a folded condition and the opposing joint sides are joined to form said sheet into a box;

affixing a sheet of decorative paper to one surface of the sheet of construction material at each of the minor flaps, the paper extending across a portion of the surface of each major end flap;

folding at least two of the folding creases;

joining the joint sides to form a flattened box tube;

folding the remaining creases to form an open box tube shape;

folding one pair of the major end flaps to close one end of the box tube;

folding the corresponding minor end flaps and a portion of the wrapping paper affixed to the minor end flaps over the major end flaps, thereby causing a portion of the wrapping paper formerly covering a portion of each major end flap to assume a folded shape;

creasing the folds of the folded portions of the wrapping paper to form a pair of opposing wrapping paper flaps;

folding the opposing wrapping paper flaps over the end flaps to overlap one another;

affixing the overlapping wrapping paper flaps together to close one end of a wrapped box;

inserting an article in the box; and closing the other end of the box by performing a similar series of operations with the other pair of end flaps to form a wrapped box enclosing the article.

2. The invention of claim 1 further comprising the step of:

forming mating interconnections in each pair of major flaps.

3. The invention of claim 2 wherein said mating interconnections are in the form of interlocking male tabs and female slots and the step of folding one pair of the major end flaps to close one end of the tube further comprises the step of:

mating said male and female interconnections to increase the rigidity of the box.

4. The invention of claim 1 wherein the step of affixing said sheet of decorative paper to said sheet of construction material further comprises the step of:

tacking said paper to said construction material at the inner edges of each of said minor flaps.

* * * * *